United States Patent [19]

Flockenhaus et al.

[11] 4,352,618

[45] Oct. 5, 1982

[54] METHOD OF, AND APPARATUS FOR PREVENTING THE UNINTENDED CHARGING OF COKE OVEN CHAMBERS

[75] Inventors: Claus Flockenhaus; Horst Joseph, both of Essen; Joachim Meckel, Heiligenhaus, all of Fed. Rep. of Germany

[73] Assignees: Bergwerksverband GmbH; Didier Engineering GmbH, both of Essen, Fed. Rep. of Germany

[21] Appl. No.: 145,766

[22] Filed: Apr. 30, 1980

[30] Foreign Application Priority Data

May 5, 1979 [DE] Fed. Rep. of Germany ..... 2918151

[51] Int. Cl.[3] ..... C10B 31/04

[52] U.S. Cl. ..... 414/148; 414/161; 414/786

[58] Field of Search ..... 414/148, 161, 162, 163, 414/289, 294, 296, 786; 202/262

[56] References Cited

U.S. PATENT DOCUMENTS 4,058,230 11/1977 Bellenberg et al. ..... 414/148

4,094,494 6/1978 Mahr ..... 414/161 X

*Primary Examiner*—Robert G. Sheridan

*Attorney, Agent, or Firm*—Michael J. Striker

[57] ABSTRACT

A method and an apparatus are described for preventing the unintentional introduction of coal from a supply into a coke oven which already contains a charge of coal or coke. An obstruction sensor is lowered through a charging hole in the ceiling of the oven; if it encounters an obstruction, such as a charge of coal or coke in the oven, it triggers a signal which blocks any discharge of coal through the charging hole into the oven.

12 Claims, 4 Drawing Figures

METHOD OF, AND APPARATUS FOR PREVENTING THE UNINTENDED CHARGING OF COKE OVEN CHAMBERS

BACKGROUND OF THE INVENTION

This invention is generally concerned with the filling of coke oven chambers.

More particularly, the invention relates to a method for preventing unintended charging of coke oven chambers.

The invention also relates to apparatus for carrying out this method.

The accidental charging (admission) of coal into already full coke oven chambers, or into those which are still closed, is a safety hazard. It is particularly hazardous if the coal being thus admitted is preheated, because such preheated coal tends to smolder or even burst into flame in the presence of oxygen, i.e., when the aforementioned conditions obtain.

A proposal has been made in German Published Application OS No. 2,313,441 for a device which monitors the filling level of a coke oven during the filling thereof, and interrupts the further admission of coal when a predetermined level is reached. This, however, is strictly limited to supervision of the filling level while the actual filling takes place and therefore cannot prevent accidental charging in situations where no such charging should be occurring in the first place.

It is also known to automate the charging process using e.g., preheated coal. In such a system a preselector (or a computer) can determine in advance which of the several coke oven chambers is to be charged, so that even if the charging car should travel to the wrong chamber due to an error or a malfunction, a charging operation for the wrong chamber cannot be initiated. Even then, however, there is no absolute guarantee against accidental charging. For example, a program malfunction may make it necessary to switch over from automated operation to manually controlled operation, thereby restoring the danger of accidental charging.

SUMMARY OF THE INVENTION

Accordingly, it is an object of the present invention to overcome the disadvantages of the prior art.

A more particular object of the invention is to provide a highly reliable and simple method of preventing the accidental charging of already filled (i.e., from a previous filling operation) or still filled (i.e., with the filling already approaching the time of discharge as coke) coking chambers.

Another object is to provide apparatus for carrying out the method according to the invention.

In keeping with these objects and still others which will become apparent hereafter, one aspect of the invention resides in a method of preventing unintended charging of coking chambers. Briefly stated, such a method may comprise the steps of lowering an obstruction sensor through the opening and into the coke oven prior to initiation of a charging operation; and blocking the initiation of the charging operation in the event the sensor encounters an obstruction during its descent towards and within the coke oven.

An apparatus for carrying out the above method may comprise an obstruction sensor; means for lowering the obstruction sensor through the charge hole and into the coke oven; and means for blocking the initiation of a coal charging operation in the event the descending sensor encounters an obstruction.

As a general rule, charging of a coking chamber is effected by removing the plug(s) from the charging opening(s) in the ceiling of the oven chamber, establishing by means of a hole, tube, chute or the like a connection between the hole(s) and a coal supply device (e.g., a scraper conveyor), and then opening previously closed valves or other devices to permit gravity flow of the coal into the filling hole(s). It is also known to have permanent connections between the charging holes and the coal supply device, but this does not change the overall charging method.

In the context of the overall charging operation the invention proposes to lower—prior to initiation of coal admission—a sensor of a contact switch through a charging hole into the coking chamber. If the descending sensor encounters resistance—e.g., from a non-removed plug of the charging hole, a non-opened coal-discharge valve or similar device, or within the chamber the upper surface of a recently admitted coal charge or of a charge already converted to coke—then the contact switch—which together with the device for lowering the sensor is located outside the charging tube—is actuated and blocks the opening of the coal discharge valves or analogous devices. The blocking may be effected mechanically, electrically or pneumatically and prevents the admission of additional coal into the coking chamber in question. The device for lowering the sensor may operate electrically, mechanically or pneumatically, in a manner known per se. Blocking of the coal discharge valves interrupts further filling until the source of the problem is identified and corrected.

Conversely, if the sensor encounters no resistance on being lowered into a coking chamber, then the contact switch is not operated and charging of coal commences. The sensor may be left in place during the charging, or be retracted to its starting position before charging begins; this depends upon the type of sensor used. Charging of already filled chambers with additional coal, charging of coal into chambers still containing coke, and charging of coal in conditions when the charging-hole plug is not removed or an analogous problem exists, is in any event reliably avoided.

It is within the concept of the invention to provide a plurality of sensors and to lower each into a different charging hole of the same coking chamber. These sensors may either all act on one and the same contact switch, or they may each act upon a separate contact switch; in the latter case the first activated contact switch blocks the admission of coal. This further increases the safety factor.

A very simple and reliable contact switch can be obtained by using an electro-mechanical overload protector with a limit switch.

The sensor may be lowered into the chamber to a depth below the level to which the chamber would normally be expected to be filled. Insofar as the filling level of a fresh coal filling is concerned, this means several tenths of a meter up to about one meter, depending upon the number of charging holes, the filling speed and the type of coal, all of which have an influence on the filling level. This measure avoids detection errors, which might occur due to shrinkage of the chamber contents resulting from progress of the coking operation or else from non-uniform filling of the (horizontal) chamber in its longitudinal direction.

Once the sensor contacts an obstruction, its further descent may be terminated especially if the sensor is a rigid one which could otherwise become damaged.

It is known to use probes which monitor the extent to which a coke oven chamber is filled, throughout the charging operation. If this is combined with the present invention and a rigid probe is used, then it is advisable to lower such probe or probes into the coking chamber only after the sensor has previously descended to the full extent without responding to an obstruction. This prevents damage to the probe in the event the chamber is still closed, or still (or already) filled. However, if the probe and sensor are appropriately constructed they can be lowered simultaneously, which has the advantage of speeding up the operations. In this latter case provision may be made to terminate further lowering of the probe once the sensor responds to an obstruction, thereby preventing possible damage to the probe.

When the sensor responds to an obstruction, it will block the charging of coal into the chamber in question. In addition it may, however, also provide a visual and/or audible signal, to alert an operator to the problem and to allow him to immediately take the necessary preparatory steps to charge a different chamber, so that only a minimum of time will be lost.

According to a particularly advantageous embodiment of the invention the sensor is arranged in and lowerable from that part of the filling pipe (or chute) of the charging device, which during the charging is located directly above the charging opening of the chamber. This makes it possible to lower the sensor vertically through the opening and into the chamber. The contact switch and the lowering device, however, are preferably located outside the filling pipe where they are less subject to wear and damage.

Another advantageous embodiment provides for the sensor and the probe to be integrated, i.e., to so construct the sensor that it can simultaneously also perform the probe functions. This results in a simplification of the overall arrangement since e.g., only a single mechanism for raising and lowering is needed. An integrated sensor and probe cooperating with the contact-switch arrangement of the invention, may make use of the pressure tube disclosed in the aforementioned German Published Application OS No. 2,313,441. In accordance with the invention such a pressure tube will additionally be provided with an overload protector, preferably of electromechanical type, and will be so arranged that it is lowered into the chamber before charging can be initiated in order to finish the required control signals in the event it encounters one of the earlier-mentioned obstructions. A particular advantage of such an embodiment is that a single integrated device serves not only to prevent undesired charging but also permits the increasing filling state of the chamber to be monitored as the chamber is charged with e.g., preheated coal.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DESCRIPTION OF THE PREFERRED EMBODIMENTS

The inventive method and apparatus for carrying it into effect, will hereinafter be conjointly described with reference to the drawings.

Figure 1:
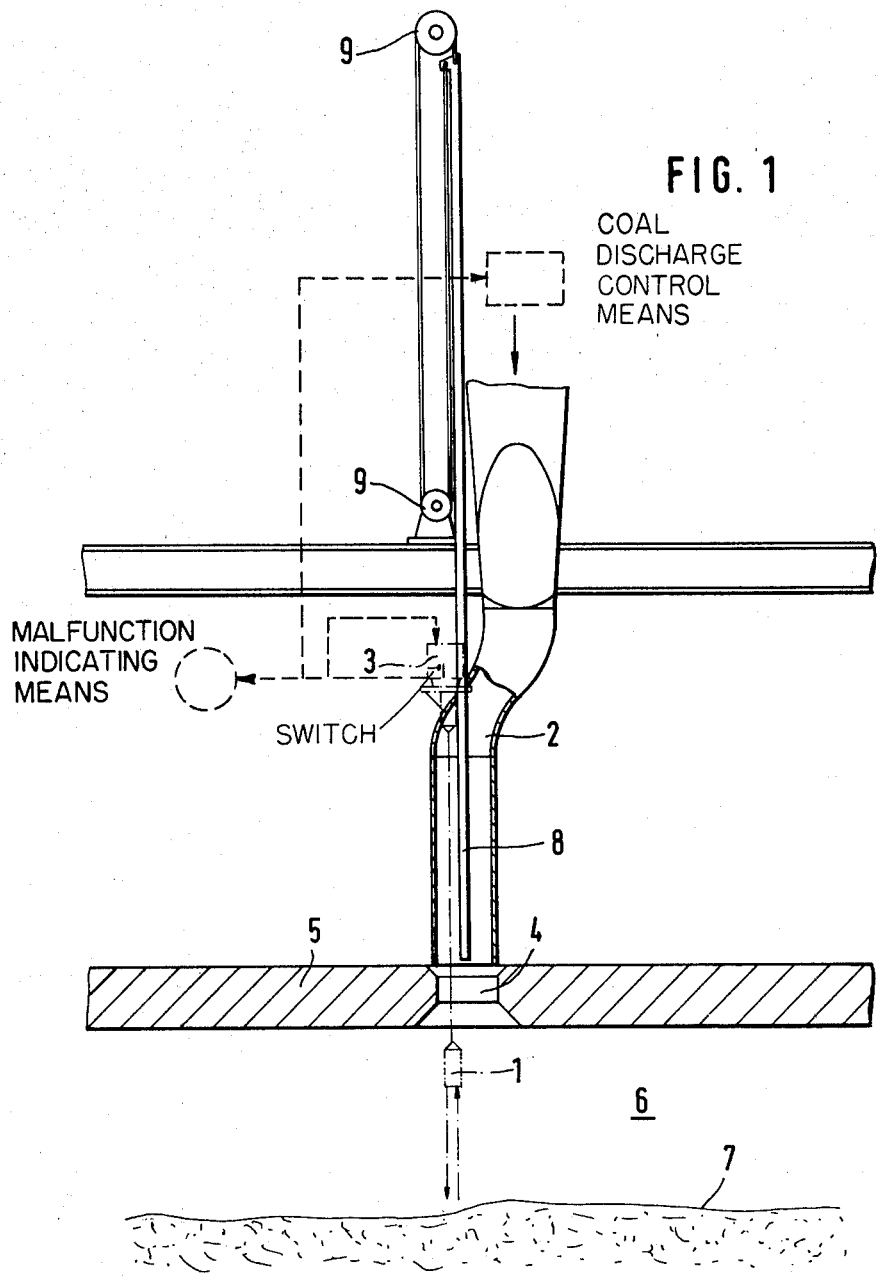
FIG. 1 is a fragmentary detail view illustrating one embodiment of the invention and a portion of a coke oven ceiling.

A first embodiment of the invention is shown in FIG. 1, wherein reference numeral 5 designates a portion of the ceiling of a horizontal coke oven chamber 6 containing a charge 7 (which may be freshly filled coal or else coke). The ceiling 5 has one or more (not shown) charging holes 4 in it through which particulate or pulverulent coal (preheated or not) can be charged into the chamber 6.

A sensor 1, e.g., a weight suspended on an elastic band, is located vertically beneath a raising and lowering device 3 located outside the charging pipe 2; to permit this vertical relationship the pipe 2 is provided with the illustrated bend which allows sensor 1 to be vertically below device 3 despite the fact that device 3 is located outside the pipe 2. Sensor 1 is lowered by the device 3 through the lower portion of pipe 2 and through opening 4 into the chamber 6. The contact switch (known per se) forms a part of device 3; it is electrically connected (circuit known per se) with the devices which control the discharge of coal from the not-illustrated coal supply equipment through pipe 2. If sensor 1 encounters a plug (not shown) in opening 4, or a closed valve or similar device (not shown) in pipe 2 which prevents discharge of coal from the pipe, or in the absence of either of these obstructions enters chamber 6 and encounters the upper surface of the charge 7 therein, it triggers the contact switch in device 3 and thus prevents any discharge of coal through pipe 2 into chamber 6.

A probe 8 is provided for the purpose of sensing the filling level when charging of the chamber 6 does occur. It is suspended from a separate lowering device 9 which is mounted upwardly of the coke oven ceiling 5. The probe 8 is lowered only when the sensor 1 has first been lowered into the chamber 6 to the required extent and has encountered no obstacles; i.e., when it has been determined that the chamber 6 is ready to receive a coal charge.

Figure 2:
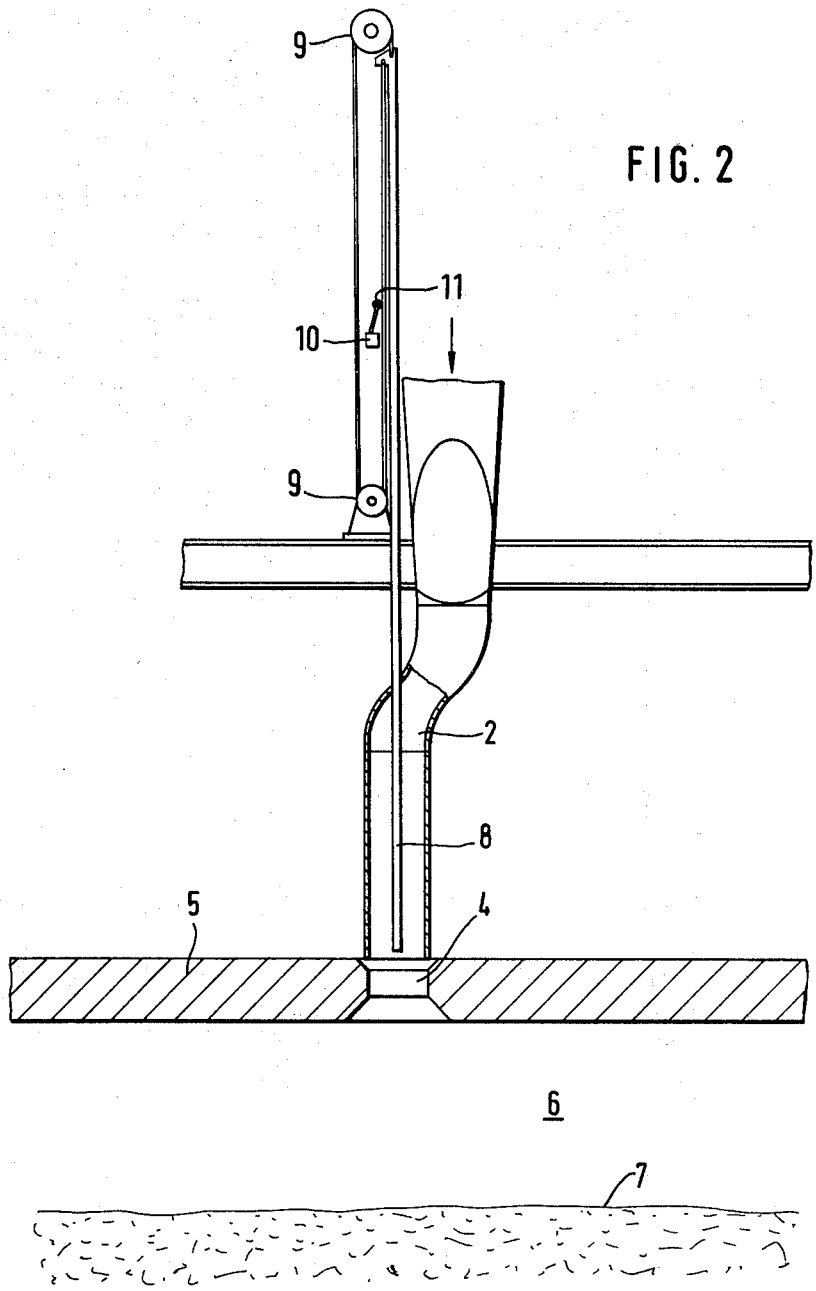
FIG. 2 is a view similar to FIG. 1, but showing another embodiment.

In this embodiment—and this is also true of FIG. 2—the pipe 2 is permanently connected with the charging opening 4 and with the not-illustrated coal supply device. It should be understood, however, that the invention can equally well be employed with all other known charging arrangements, including those in which after removal of the plug or cover for the charging opening a connection must each time be established between the charging opening and the coal supply device.

The embodiment of FIG. 1 is especially advantageous in circumstances where a battery of coke ovens is already provided with the probes 8 and is to be additionally retrofitted with the present invention. The device 3 may include a direction-reversible electric motor and the weight 1 be suspended on an elastic band or on e.g., a chain. When the weight 1 encounters an obstruction the band or chain becomes slack; this results in direction-reversal of the motor in device 3 and the weight is immediately raised again, so that it contacts the obstruction only for a brief period of time. Concomitantly with direction-reversal of the motor, the contact switch (i.e., the one which is triggered by such contact) produces a signal which prevents lowering of the probe 8, prevents discharge of coal through pipe 2 and triggers a visual and/or audible signal to indicate a malfunction.

The embodiment of FIG. 2 is reminiscent of FIG. 1 and like elements therein have the same reference numerals as in FIG. 1. In FIG. 2, however, a separate sensor (weight 1) and lowering device therefor are omitted. In lieu of these elements the lowering device 9 for the probe 8—which latter is suspended from e.g., a band or a chain—is provided with a chain tension adjuster 11 having a switching contact connected to the contact switch 10. The probe 8 extends through the bend in pipe 2 so as to travel coaxially in the same. If it encounters an obstacle during its descent, the band or chain slackens and this is transmitted via the contact to the switch 10, triggering the same signals as in FIG. 1. The motor of lowering device 9 may be automatically reversed as a function of the slackening and raise the probe 8. Thus, the probe in FIG. 2 has a dual function, i.e., as a sensor and thereafter, if no obstacles are encountered, as the actual probe.

Figure 3A:
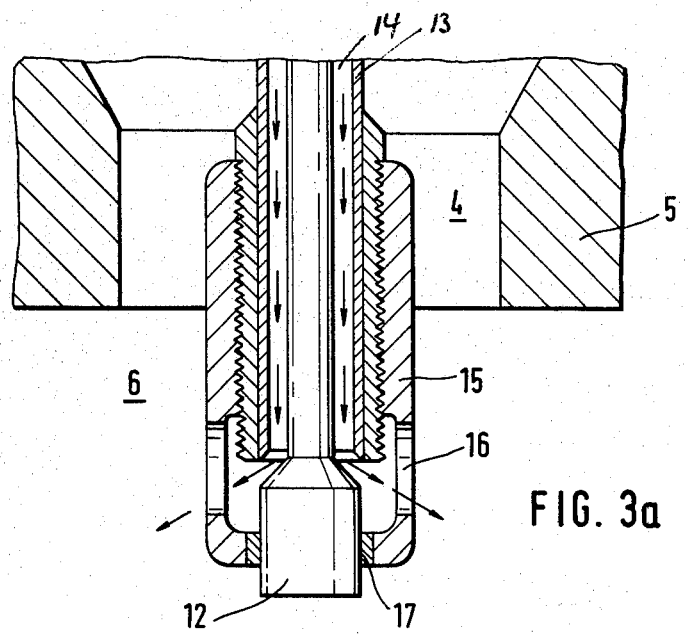
FIGS. 3A and 3B show a detail, in section, of still another embodiment in the two end positions thereof.
Figure 3B:
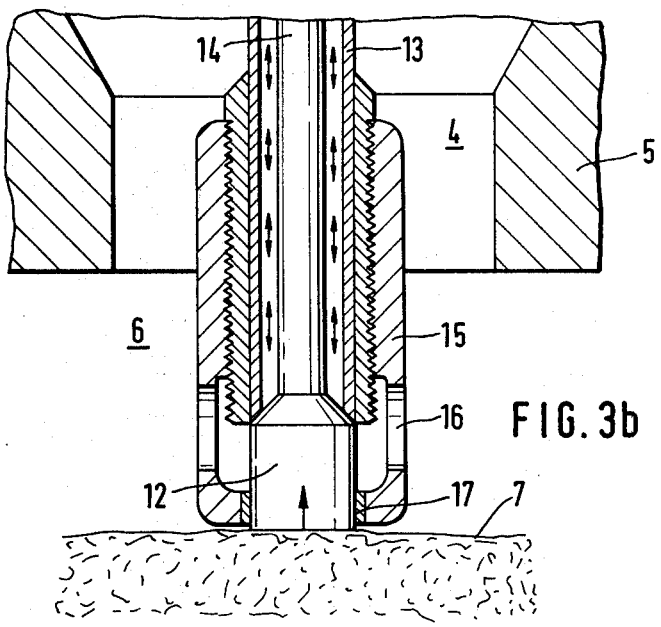

A third embodiment is illustrated in FIGS. 3A and 3B. In FIG. 3A a tube 13 which can be raised and lowered is seen to extend through a charging hole 4 in ceiling 5 and into a coking chamber 6. A mounting rod 14 extends through tube 13 and its lower end is connected with a plug 12 by an annular bevel surface, as shown. The lower end of tube 13 is formed at the inner side with a corresponding bevel seat, as shown.

Air, or preferably an inert gas such as nitrogen, is passed down the tube 13 in the clearance between the same and the rod 14 (see the arrows). The manner in which this can be done is disclosed in OS No. 2,313,441 to which reference may be had for details. In the position of FIG. 3A the gas can escape unhindered, indicating that the device has encountered no obstacle and that the chamber 6 is in condition to receive a charge of coal. In the position of FIG. 3B, however, the descending device has encountered the upper surface of a fresh coal charge 7 in chamber 6, or else of a charge of coke therein. The rod 14 and plug 12 together have a certain freedom of movement upwardly relative to tube 13, or else plug 12 can move upwardly relative to tube 13 and rod 14. In any event, the plug 12 moves into sealing engagement with the bevelled seat of tube 13 when the plug 12 encounters an obstacle. This prevents the further escape of gas from the clearance between tube 13 and rod 14. As a result the gas pressure in the clearance rises at once and this variation can be sensed by a not illustrated (known per se) pressure differential switch which acts on the contact switch and produces a signal to control the functions discussed previously. However, instead of the escape (and subsequent blockage) of gas, a contact switch (not shown) could also be mechanically actuated as a function of the relative movement of rod 14 and tube 13, or of plug 12 relative to rod 14. In any event, triggering of the respective switch results in immediate cessation of the lowering movement (to prevent mechanical overloading of the device and damage to the same) and blockage of any coal discharge into opening 4. A sleeve or cage 15 is provided which surrounds the cover portion of tube 13 and has lateral openings 16 for the escape of the gas, and a lower opening for passage of the plug 12. It prevents damage to the valve seat and the bevelled surface on plug 12.

While the invention has been illustrated and described as embodied in the context of a coke oven, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. Method for preventing unintentional charging of coal through an opening in the ceiling of a plurality of coke ovens from a coal supply device above the ceiling, comprising the steps of lowering a single one of obstruction sensors through the opening of and into a respective one of the coke ovens prior to initiation of a charging operation for the respective coke oven; blocking the initiation of the charging operation for the respective coke oven in the event the sensor encounters an obstruction during its descent towards and within this respective coke oven; and lowering a filling level indicating probe into a respective one of the coke ovens in the event the sensor fails to encounter an obstacle during its descent.

2. Method as defined in claim 1, wherein the first-mentioned step of lowering comprises causing the sensor to descend in the respective coke oven to a level lower than the upper level to which the coke oven is filled when being charged with coal.

3. Method as defined in claim 1; and further comprising the step of terminating the lowering of the sensor in the event the sensor encounters an obstacle in the respective coal oven.

4. Method as defined in claim 1, wherein said second-mentioned lowering step includes lowering a filling level indicating probe through the opening of and into a respective one of the coke ovens concomitantly with the lowering of the respective obstruction sensor.

5. Method as defined in claim 1; and further comprising the step of generating a malfunction indication in response to the sensor encountering an obstacle in the respective coke oven.

6. Method for preventing unintentional charging of coal through an opening in the ceiling of a plurality of coke ovens from a coal supply device above the ceiling, comprising the steps of lowering a single one of obstruction sensors through the opening of and into a respective one of the coke ovens prior to initiation of a charging operation for the respective coke oven; blocking the initiation of the charging operation for the respective coke oven in the event the sensor encounters an obstruction during its descent towards and within this respective coke oven; lowering a filling level indicating probe through the opening of and into a respective one of the coke ovens concomitantly with the lowering of the respective obstruction sensor; and terminating the lowering of the probe in response to the respective sensor encountering an obstacle.

7. Apparatus for preventing unintentional charging of coal from a coal supply device through a charge pipe and a charge hole in the ceiling of a plurality of coke ovens wherein the charge pipe for the respective coke oven has a portion which is located vertically above the charge hole prior to charging, the apparatus comprising means for lowering a single one of obstruction sensors through the charge hole of and into a respective one of the coke ovens so that said sensor passes vertically through said portion; means for blocking the initiation of a coal charging operation for the respective coke oven in the event the descending sensor encounters an obstruction in this respective coke oven, both of said means being arranged exteriorly of said charge pipe; and a filling level probe integrated and movable with each of said sensors.

8. Apparatus as defined in claim 7, said lowering means being operative for lowering said sensor in the respective coke oven to a level lower than the upper level to which the coke oven is filled when being charged with coal.

9. Apparatus as defined in claim 7, said blocking means including switch means which are also operative for deactivating said lowering means in response to said sensor encountering an obstruction in the respective coke oven.

10. Apparatus as defined in claim 7; and further comprising malfunction-indicating means operatively connected with said sensor to be activated when the sensor encounters an obstruction in the respective coke oven.

11. Apparatus for preventing unintentional charging of coal from a coal supply device through a charge pipe and a charge hole in the ceiling of a plurality of coke ovens, the apparatus comprising means for lowering a single one of obstruction sensors through the charge hole of and into a respective one of the coke ovens; means for lowering a filling level indicating probe into a respective one of the coke ovens in the event the sensor fails to encounter an obstacle during its descent; and means for blocking the initiation of a coal charging operation for the respective coke oven in the event the descending sensor encounters an obstruction in this respective coke oven.

12. Apparatus as defined in claim 11, said lowering means for the probe being operatively connected with said blocking means.

* * * * *